US005203494A

United States Patent [19]

Blomfield

[11] Patent Number: 5,203,494

[45] Date of Patent: Apr. 20, 1993

[54] STACKABLE PACKAGE

[75] Inventor: Gregory T. Blomfield, Auckland, New Zealand

[73] Assignee: PrintPac-Ueb Limited, Penrose, New Zealand

[21] Appl. No.: 838,096

[22] Filed: Feb. 20, 1992

[30] Foreign Application Priority Data

Feb. 20, 1991 [NZ] New Zealand ..... 237169

[51] Int. Cl.[5] ..... B65D 5/04

[52] U.S. Cl. ..... 229/148; 229/919; 229/DIG. 11; 206/509

[58] Field of Search ..... 229/199, 915, 919, 148, 229/186, DIG. 11; 206/508, 509, 511

[56] References Cited

U.S. PATENT DOCUMENTS

| | | | |
|---|---|---|---|
| 2,893,621 | 7/1959 | Harnish et al. | 229/DIG. 11 |
| 3,448,914 | 6/1969 | Scholz | 229/15 |
| 3,713,579 | 1/1973 | Chaffers | 229/DIG. 11 |
| 3,820,706 | 6/1974 | Gibson et al. | 229/DIG. 11 |
| 3,905,541 | 9/1975 | Paxton | 229/23 |
| 4,134,533 | 1/1979 | Heavner | 229/34 |
| 4,158,410 | 6/1979 | Novatny | 229/DIG. 8 |
| 4,175,691 | 11/1979 | Cornell et al. | 229/36 |
| 4,291,830 | 9/1981 | Sorenson | 229/DIG. 11 |
| 4,304,351 | 12/1981 | Stollberg | 229/915 |
| 4,347,968 | 9/1982 | Cornell et al. | 229/33 |
| 4,497,408 | 2/1985 | Jes | 229/DIG. 11 |
| 4,650,112 | 3/1987 | Booth | 229/156 |
| 4,884,739 | 12/1989 | Nedeveld | 229/109 |
| 4,911,356 | 3/1990 | Townsend et al. | 229/166 |

FOREIGN PATENT DOCUMENTS

| | | |
|---|---|---|
| 2449605 | 9/1980 | France . |
| 220172 | 1/1987 | New Zealand . |

*Primary Examiner*—Allan N. Shoap
*Assistant Examiner*—Christopher McDonald
*Attorney, Agent, or Firm*—Jacobson, Price, Holman & Stern

[57] ABSTRACT

A stackable package for storing fruit or like objects is in the form of a tray, carton or case (1) with a pair of panel supports (6) provided adjacent each end wall. The panel supports (6) substantially bear the weight of like packages positioned thereabove when a stack of packages is formed. The panel supports have a pair of protrusions (8) on the upper edge thereof and a pair of recess (14) adjacent the lower edge thereof wherein the protrusions can be positioned in the recesses of a package positioned thereabove when two or more packages are stacked. So that a stiff protrusion is provided, the panel support is formed from dual arch corrugated board having two layers of corrugated board joined at the protrusions. The wedge-shaped protrusions (8) thus produced can be readily indexed in adjacent recesses (18) in the base of a carton stacked above and in top lid apertures (23, 24) in the closed and open positions.

14 Claims, 3 Drawing Sheets

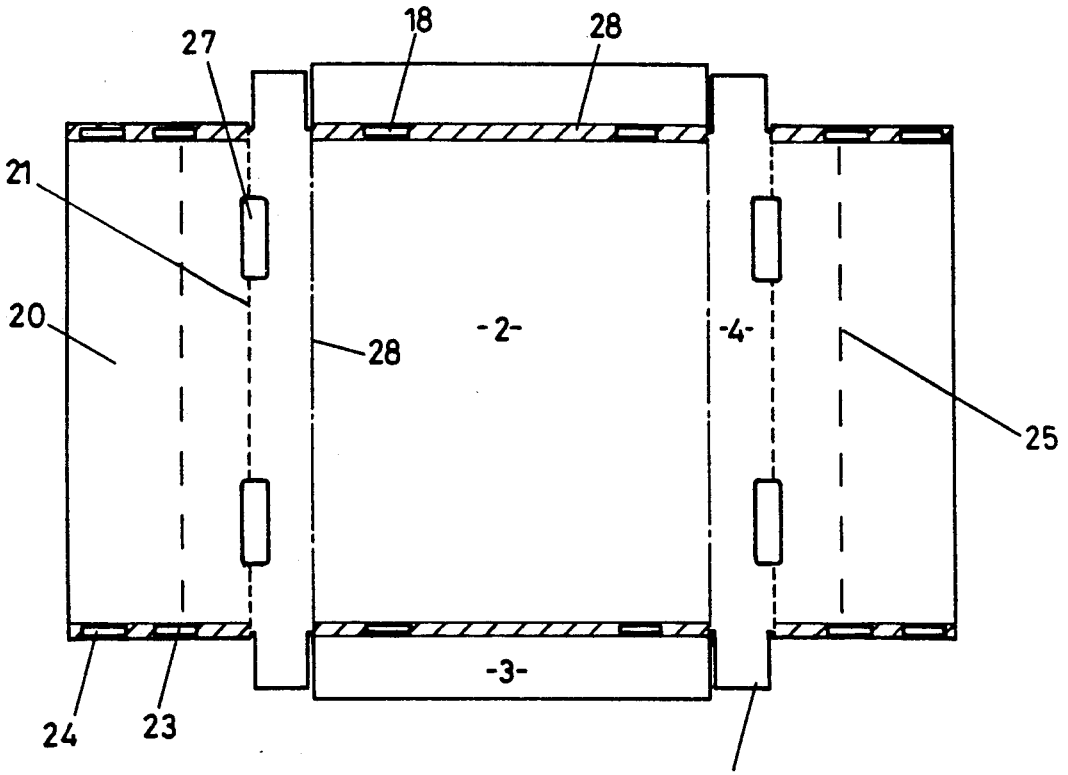
FIG 1
FIG 2
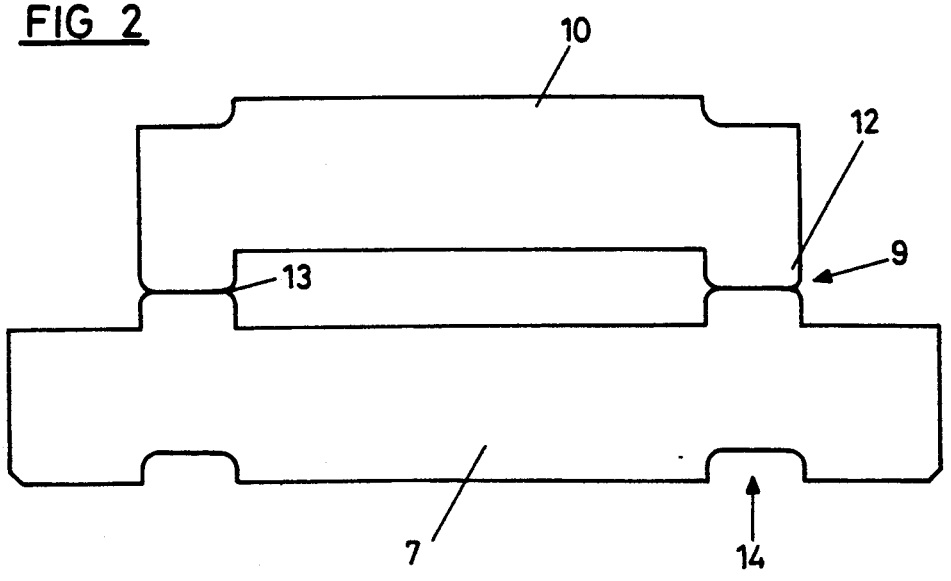

STACKABLE PACKAGE

BACKGROUND OF THE INVENTION

This invention relates to stackable containers and more particularly to such containers for transporting articles such as fruit.

Packages formed from corrugated board may be used to transport articles such as fruit. Often, a stack of packages is formed for transportation. New Zealand Patent 220172 shows a package wherein protrusions are provided on end panels which can be positioned in corresponding recesses of an adjacent package in a stack. This enables a stack of packages to be readily formed.

This earlier construction provides panels formed from molded plastics or wood products. This confers strength on the resultant package. However, use of a plastic or wood insert is not environmentally friendly. Further, having panels formed from different material to the rest of the package may increase the complexity of the manufacturing process.

BRIEF SUMMARY OF THE INVENTION

It is therefore an object of the present invention to provide a package which will obviate or minimize the foregoing disadvantages in a simple yet effective manner.

Accordingly the invention consists in a stackable package comprising a tray, carton or case having a base, side walls, and at least one pair of panel supports within the tray, carton or case positioned adjacent the end walls and/or the side walls, protrusions and recesses on each panel support, the protrusions being positionable in recesses of an adjacent package wherein the panel supports are formed from corrugated board having a twin or multi-ply medium so as to provide a substantially stiff protrusion.

The invention may also be said to consist in a three piece corrugated board blank which may be erected into a stackable package having a pair of panel supports comprising a body piece and a pair of panel support pieces the body piece comprising a base panel, a pair of end wall panels and a pair of side wall panels, the end wall panels and side wall panels being connected to the base panel by fold lines; the panel support pieces having protrusions and recesses provided on opposing edges of the panel supports so as to be vertically aligned in use.

In a further aspect, the invention relates to a support panel for use in a stackable package, the support panel being formed from corrugated board having a twin or multi-ply medium and comprising a pair of elongate panel components having protrusions adjacent the upper edges thereof and vertically aligned recesses adjacent the lower edge thereof and wherein the panel components are connected by fold lines at the junction between the protrusions so as to provide substantially wedge-shaped protrusions of double corrugated board thickness on the support panel.

Furthermore, the invention provides a tray, carton or case reinforcing element formed from a self-supporting sheet material selected from the group consisting of thick paper board, multiple-ply paper board and paper board with a sandwiched corrugated core, the element having:

a first elongate region;

a second elongate region; and at least a pair of bridging regions fixing the elongate regions in a spaced but substantially parallel juxtaposition (having regard to their elongate axis), the bridging regions being folded or foldable to have one elongate region lying against the other (though not necessarily co-extensively) while defining a number of projections of double sheet thickness extending laterally of the substantially common longitudinal axis with the distal ends of the projections being the fold;

the construction and arrangement being such that in such a folded condition the reinforcing element is positionable within a tray, carton or case against each of two opposed end walls thereof to provide with the folded bridging regions projections above the end walls of the tray, carton or case capable of being indexed into recesses on a like tray, carton or case positioned thereabove or therebelow in a stacking manner.

Finally, the invention also pertains to a tray, carton or case of a kind having a base, side walls and end walls wherein each end wall is reinforced by a reinforcing element formed from a self-supporting sheet material selected from the group consisting of thick paper board, multiple ply paper board and paper board with a sandwiched corrugated core, the element having a first elongate region;

a second elongate region; and at least a pair of bridging regions fixing the elongate regions in a spaced but substantially parallel juxtaposition (having regard to their elongate axis), the bridging regions being folded or foldable to have one elongate region lying against the other (though not necessarily co-extensively) while defining a number of projections of double the sheet thickness extending laterally of the substantially common longitudinal axis with the distal ends of the projections being the fold;

the construction and arrangement being such that in such a folded condition the reinforcing element is positionable within a tray, carton or case against each of two opposed end walls thereof to provide with the folded bridging regions projections above the end walls of the tray, carton or case capable of being indexed into recesses on a like tray, carton or case positioned thereabove or therebelow in a stacking manner.

To those skilled in the art to which the invention relates, many changes in construction and widely differing embodiments and applications of the invention will suggest themselves without departing from the scope of the invention as defined in the appended claims. The disclosures and the descriptions herein are purely illustrative and are not intended to be in any sense limiting.

BRIEF DESCRIPTION OF THE DRAWINGS

One preferred form of the invention will now be described with reference to the accompanying drawings wherein:

FIG. 1 is a top plan view of a blank for use in forming a tray, carton or case according to one preferred form of package according to the invention;

FIG. 2 is a plan view of a blank able to form a panel support according to the preferred form of the invention;

DETAILED DESCRIPTION

Figure 3:
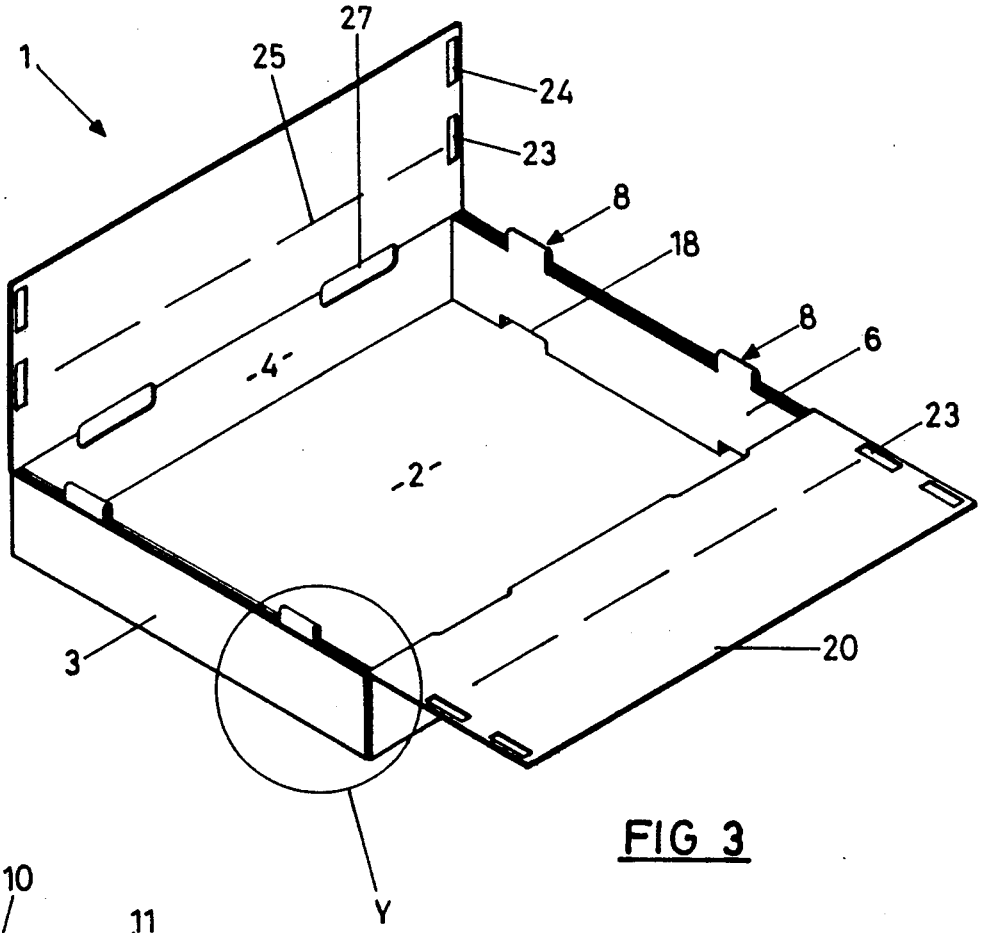
FIG. 3 is a perspective view of the assembled package according to the preferred form of the invention.
Figure 5:
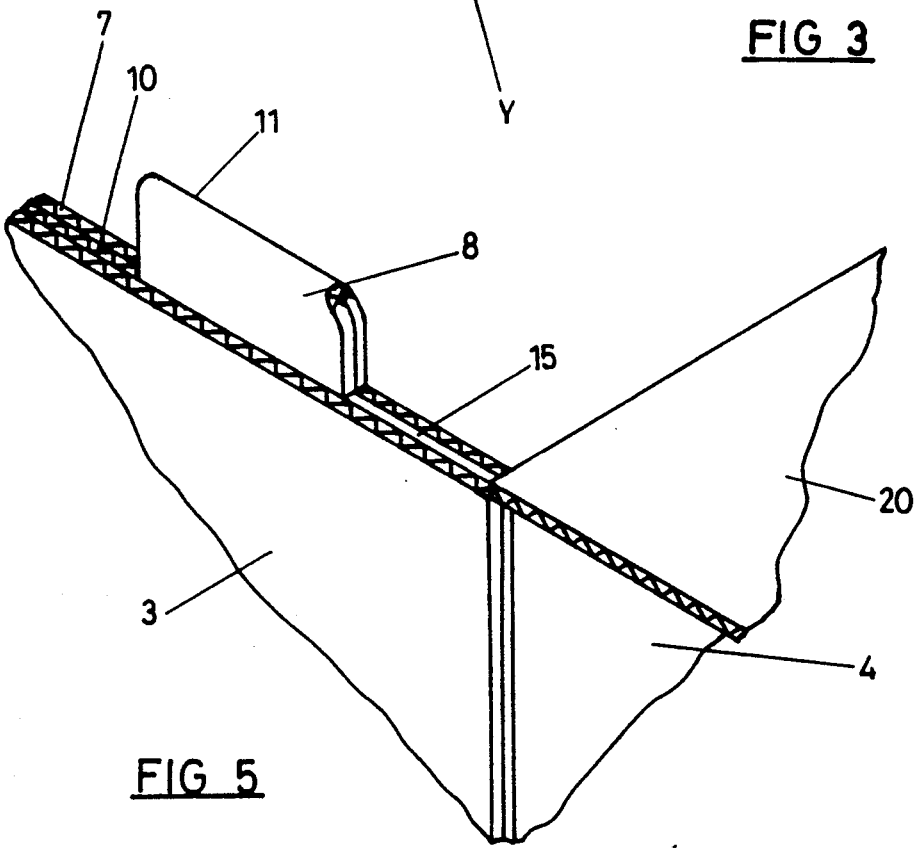
FIG. 5 is a detailed view of the corner encircled at Y in FIG. 3.

The invention relates to a stackable package suitable for holding fruit or other similar objects for transportation.

The stackable package is in the form of a tray, carton or case 1. The tray, carton or case 1 has a generally rectangular base 2 and a pair of end walls 3 extending upwardly therefrom. A pair of side walls 4 are also provided which extend upwardly from the base 2.

The package has a pair of panel supports or reinforcing elements 6 which are provided adjacent the end walls 3 and/or the side walls 4. Desirably, a pair of panel supports 6 are provided adjacent each end wall 3. The panel supports 6 are formed from a self-supporting sheet material selected from the group consisting of thick paper board, multiple-ply paper board and paper board with a sandwiched corrugated core (hereinafter referred to as corrugated board with the corrugations constituting the "medium"). In the preferred embodiment of the invention however, the panel supports 6 are formed from corrugated board which has a twin or multi-ply medium and includes stiffening agents (commonly referred to as "dual-arch" material). The corrugated board may be formed by the process described in patent GB2,101,039 for example. Conveniently, the tray, carton or case 1 is also formed from corrugated board which may also be dual-arch material.

Use of dual-arch material to form the panel supports 6 provides for a substantially stiff protrusion 8 of the panel support 6 (to be described later herein).

Figure 4:
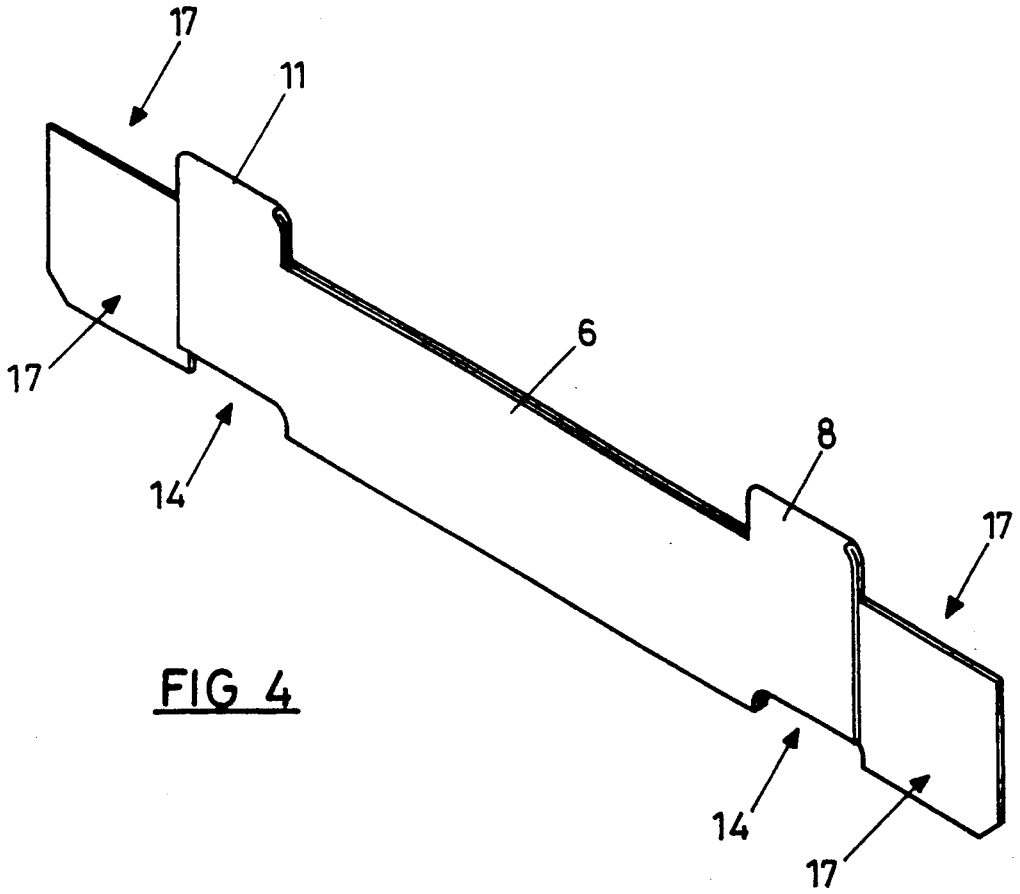
FIG. 4 is a perspective view of a panel support according to one preferred form of the invention.

The invention also provides a panel support 6 which can be used to reinforce a tray, carton or case. Desirably, the panel support 6 is used in a stackable package as disclosed herein. The panel support 6 comprises a first elongate region or panel component 7 and a second elongate region or panel component 10. At least a pair of bridging regions 9 fix the elongate regions or panel components 7 and 10 in a spaced but substantially parallel juxtaposition having regard to the elongate axis of the elongate regions 7 and 10. The bridging regions 9 can either lay flat so as to be foldable (i.e. as shown in FIG. 2) or can be folded into a panel support 6 as shown in FIG. 4. Once folded, one elongate region 7 lies against the other elongate region 10 but not necessarily co-extensively. In the folded condition, a number of projections or protrusions 8 of double the sheet thickness extend laterally of the substantially common longitudinal axis of the elongate regions 7 and 10. The distal ends 11 of the protrusions 8 may for example form the fold between the panel components 7 and 10. Thus, the panel components 7 and 10 may each have a pair of protrusions 12 with a fold line 13 therebetween and can be folded so as to form the panel component 6. In the folded condition, the protrusions 8 are desirably provided on the upper edge of the panel component 6 and vertically aligned recesses 14 are provided in the lower edge of the panel component 6.

Desirably, the two elongate regions 7 and 10 are adhered together.

In the folded condition, the panel support 6 is positionable within a tray, carton or case against each of two opposed end walls thereof to provide, with the folded bridging regions 9, projections or protrusions 8 above the end walls 3 of the tray, carton or case 1. These protrusions 8 are capable of being indexed, or are positionable, in recesses 18 of a tray, carton or case positioned thereabove or therebelow in a stacking manner.

The panel support 6 is desirably transversely asymmetrical so as to be suitable for use with the tray, carton or case of the preferred embodiment (the blank of which is shown in FIG. 1). As shown in FIG. 1, the side walls 4 of the tray, carton or case 1 have a pair of foldable tabs 15 which extend from each end thereof. In the completed package, the tabs 15 are folded so as to be positioned against the adjacent end walls 3. The tabs 15 are adhered to the end walls 3. So as to accommodate the area taken up by the tabs 15, one of the panel components 10 is shorter in length than the other panel component 7. Thus, a pair of recesses 17 are provided adjacent each end of the panel support 6. The tabs 15 can be positioned in the recesses 17 in the completed package when the panel supports 6 are adhered to the end walls 3. The overall result is a pair of triple-ply end wall assemblies which maximize the internal dimensions of the package yet provide substantial support to the package when in a stack.

So that the protrusions 8 of a similar package positioned below the package can be indexed into the recesses 14, a pair of apertures 18 may be provided in the base 2 adjacent each end wall 3.

The package desirably has a lid which is in the form of two lid flaps 20 which can be folded over the package. The lid flaps 20 can for example extend from the side walls 4 and can be connected by a fold line 21. Adjacent each edge of the lid flaps 20 may be a pair of apertures 23 which correspond to the protrusions 8 and can be positioned thereover then the lid flaps 20 are closed.

A further pair of apertures 24 may be provided adjacent each end of the lid flaps 20 which are closer to the distal edge of the lid flaps 20 than the apertures 23. Furthermore, a fold line 25 may be provided which may for example be preferred to enhance the ability of the lid flaps 20 to fold under the package. The fold line 25 may for example be substantially parallel to the end walls 4 and the distance from the fold line 21 to the perforated fold line 25 may be slightly greater than the height of the side wall 4. Provision of the fold line 25 as well as the apertures 24 enables the lid flaps 20 to be folded underneath the base 2 of the package with the protrusions 8 of an underlying package able to be positioned through the apertures 24. Thus, the lid flaps 20 can be folded away such that it is convenient for a person to place articles inside the package, the internal space of which will be readily accessible.

The invention also relates to a three piece corrugated board blank. The three piece blank comprises a body piece as shown in FIG. 1 and a pair of reinforcing elements or panel support pieces as shown in FIG. 2.

The body piece shown in FIG. 1 comprises a base panel 2, a pair of end wall panels 3 as well as a pair of side wall panels 4. The end wall and side wall panels 3 and 4 are connected to the base 2 by fold lines 28. The lid flap panels 20 are connected to the side walls 4 by fold lines 21.

The panel support piece shown in FIG. 2 consists of a pair of panel components 7 and 10 each having protrusions 12. The protrusions 8 and recesses 14 are provided on and in opposing edges of the panel supports 6 so that they are vertically aligned in use.

As discussed earlier, the three piece corrugated board blank is preferably of a dual arch construction wherein the board includes stiffening agents.

The method of forming the preferred package shall now be described. The panel supports are formed by folding the panel component 7 and 10 at fold lines 13. The fold line 13 may for example be a heavy point crease. The panel components 7 and 10 are then adhered together using any suitable adhesive. Once folded, a pair of substantially wedge-shaped protrusions are provided on the support panel which are of double corrugated board thickness. The tapered shape of the protrusions 8 enables them to be readily indexed into the recesses 14 of an adjacent package.

The tray, carton or case 1 is then assembled by folding the end walls 3 and side walls 4 at the appropriate fold lines. The foldable tabs 15 are then folded and adhered to the inwardly facing surface of the end walls 3. The support panels 6 can then be adhered to both the inwardly facing surface of the end walls 3 and the tabs 15 such that the tabs 15 are positioned in the recesses 17. Of course, then the lid can be formed by folding the lid flaps 20 over the tray, carton or case 1 such that the protrusions 8 extend through the apertures 23.

When it is desired to place articles in the package, the lid flaps 20 may be folded under the base 2 and protrusions 8 of a package positioned therebelow can extend through the lid apertures 24. When packing is completed, the lid flaps 20 can be closed. A stack of packages containing articles can then be formed.

The design of the package is such that a stack of packages containing articles (such as fruit) can be formed wherein the tendency of such a stack to decrease in overall height as a result of gravity is reduced. This feature is desirable for example where a stack of loaded packages is formed for transportation and/or storage with straps positioned over the stack and it is important that the straps do not loosen around such a tank. Accordingly, the construction is such that the weight of packages positioned above a particular package is generally taken through the whole panel support 6 in at least the preferred embodiment of the invention. To this end, the height of the protrusions 8, and depth of the recesses 14 are such that only at maximum loading on the package in normal use will the distal ends 11 of the protrusion 8 contact the base of the recess 14. Furthermore, the corrugations of the corrugated board forming the areas of the lid flaps 20 which are positioned over the panel supports 6 (shown in cross-hatching in FIG. 1) are pre-crushed as is the region of the base 2 on which the panel supports rest (also shown in cross-hatching in FIG. 1). This is because the resistance of the horizontal flutes of corrugated board (i.e. those corrugations in the base 2 and lid flaps 20) is less than that of the vertical flutes (i.e. those forming the end walls 3 and the panel components 7 and 10). Given time and atmospheric exposure, in a coolstore for example, the horizontal flutes will deform resulting in height reduction of a stack of packages. Pre-crushing the cross-hatched areas will reduce the tendency of a stack to reduce in height.

Thus it can be seen that in at least the preferred form of the invention a stackable package is provided which has sturdy end wall panels which provide support to the package when provided in a stack of packages. Substantially wedge-shaped protrusions are provided which can be readily indexed into the recesses of an adjacent package thus enhancing the stackability of the package. The asymmetrical arrangement of the panel supports enables the internal dimensions of the package to be maximized. The dimensions and construction of the protrusions and recesses as well as the provision of pre-crushed lid flaps enables a stack of packages to maintain a relatively stable height. This reduces the tendency of straps secured around such a stack to loosen during transportation.

The package is formed entirely from corrugated board which is convenient for manufacturing purposes and is environmentally friendly.

I claim:

1. A stackable container comprising:

a carton formed from a single blank of a sheet material having, a substantially rectangular base, first and second end walls extending upwardly from said base, two side walls extending upwardly from said base, and two top flaps, each top flap being hinged from the top of one of said side walls to substantially close the carton in a closed position and each top flap being selectively engageable against the outer face of the respective side wall in an open position;

a first end wall reinforcing element engaging against said first end wall;

a second end wall reinforcing element engaging against said second end wall;

each end wall reinforcing element comprising a paper board of at least one corrugated ply having flutes and having at least a pair of outer plies and being formed from a blank having a first elongate region, a second elongate region shorter in length than said first elongate region so that each reinforcing element has end portions of one ply for minimizing the thickness of said end portions and maximizing the space within said container, at least two bridging regions connecting said elongate regions, and a cut out portion between said bridging regions, said blank being folded transversely through said bridging regions along fold lines substantially parallel to the elongate axis of said elongate regions to define at least two projections extending above said end walls, the flutes of the corrugations of said at least one corrugated ply extending substantially perpendicular to said base;

openings in said base adjacent each end wall reinforcing element and aligned with said at least two projections so that each opening indexes over a projection of an end wall reinforcing element of an adjacent carton in a stack of like stackable cartons; and at least one aperture in each top flap corresponding to each of said at least two projections for receiving a respective one of said at least two projections upon closing of each top flap over each end wall reinforcing element;

so that said containers are stackable with said at least two projections of each end wall reinforcing element of one container engageable in said openings in said base of an adjacent container, and engageable in said at least one aperture in said top flaps in said open and closed positions, and said top flaps strengthen the stack against racking when said containers are closed.

2. A stackable container as claimed in claim 1 wherein:

said two flaps each have a foldable portion for folding under said base when said top flaps are disposed against said outer faces of said respective side walls in an open position.

3. A container as claimed in claim 1 and further comprising:

means for adhering said reinforcing elements to respective first and second end walls.

4. A container as claimed in claim 3 wherein:

said elongate regions of said end wall reinforcing elements are disposed inwardly of said end walls.

5. A container as claimed in claim 4 wherein:

a portion of each of said first and second elongate regions of each end wall reinforcing element is disposed between said at least two projections and said one ply end portions are disposed between said projections and proximate end walls.

6. A container as claimed in claim 5 wherein:

said elongate regions are symmetrical with respect to said at least two bridging regions.

7. A stackable container as claimed in claim 1 and further comprising a tapered portion adjacent the distal end of each of said at least two projections extending from the fold line of a respective bridging region to facilitate entry of said projections in said openings in said base of an adjacent container and a respective aperture in a respective top flap in said open and closed positions.

8. A stackable container as claimed in claim 6 and further comprising a tapered portion adjacent the distal end of each of said at least two projections extending from the fold line of a respective bridging region to facilitate entry of said projections in said openings in said base of an adjacent container and a respective aperture in a respective top flap in said open and closed positions.

9. A container as claimed in claim 1 wherein:

said carton is formed from a paper board comprised of at least one corrugated ply between at least one pair of outer plies defining substantially parallel flutes, said flutes in said end walls extending substantially perpendicular to said base, and said flutes in said side walls and said top flaps extending substantially parallel to said base.

10. A container as claimed in claim 2 and further comprising:

a bottom edge on each reinforcing element engaging against said base; and cut-out recesses in said bottom edge adjacent said openings in said base for receiving said projections of end wall reinforcing elements of an adjacent stacked container.

11. A container as claimed in claim 1 wherein:

said at least one aperture in each top flap comprises a first aperture for receiving a respective projection therethrough when said top is in said closed position, and a second aperture for receiving when folded under said base in said open position a respective projection of an end wall reinforcing element of an adjacent container in the stacked position.

12. A stackable container as claimed in claim 4 wherein:

said second elongate region of each end wall reinforcing element faces a respective one of said end walls so that a tab receiving space is provided between each end wall and said first elongate region at said end portions of a respective end wall reinforcing element; and a plurality of tabs are provided on each side wall foldable substantially perpendicular to the plane of each side wall for insertion in said tab receiving spaces.

13. A container as claimed in claim 1 wherein:

said flutes in said top flaps adjacent the portions of said top flaps engaging said end wall reinforcing element in said closed position are precrushed so that when a plurality of said containers are stacked, adjacent containers have a substantially fixed position relative to each other for minimizing relative displacement thereof over a period of time.

14. A stackable container as claimed in claim 9 and further comprising:

precrushed portions on said base and top flaps in the areas thereof engaging against said end wall reinforcing elements.

* * * * *